US008430997B2

(12) United States Patent
Chen et al.

(10) Patent No.: US 8,430,997 B2
(45) Date of Patent: Apr. 30, 2013

(54) ELECTRODE FOR ELECTROLYTIC PRODUCTION OF CHLORINE

(75) Inventors: Ruiyong Chen, Saarbrücken (DE); Vinh Trieu, Saarbrücken (DE); Harald Natter, Saarbrücken (DE); Rolf Hempelmann, St. Ingbert (DE); Andreas Bulan, Langenfeld (DE); Jürgen Kintrup, Leverkusen (DE); Rainer Weber, Odenthal (DE)

(73) Assignee: Bayer MaterialScience AG, Leverkusen (DE)

( * ) Notice: Subject to any disclaimer, the term of this patent is extended or adjusted under 35 U.S.C. 154(b) by 138 days.

(21) Appl. No.: 13/162,660

(22) Filed: Jun. 17, 2011

(65) Prior Publication Data

US 2011/0308939 A1 Dec. 22, 2011

(30) Foreign Application Priority Data

Jun. 21, 2010 (DE) ..... 10 2010 030 293

(51) Int. Cl.

| | |
|---|---|
| ***C25B 11/04*** | (2006.01) |
| ***C25B 11/06*** | (2006.01) |
| ***C25B 11/08*** | (2006.01) |
| ***H01M 4/88*** | (2006.01) |

(52) U.S. Cl.
USPC ..... 204/291; 502/101

(58) Field of Classification Search ..... 204/291; 502/101
See application file for complete search history.

(56) References Cited

U.S. PATENT DOCUMENTS

| | | | | |
|---|---|---|---|---|
| 3,562,008 | A | 2/1971 | Martinsons | |
| 4,003,817 | A * | 1/1977 | Bianchi et al. | 204/290.03 |
| 4,070,504 | A * | 1/1978 | Bianchi et al. | 427/126.3 |
| 4,517,068 | A * | 5/1985 | Hinden et al. | 204/283 |
| 4,564,434 | A * | 1/1986 | Busse-Machukas et al. | 204/290.13 |
| 6,572,758 | B2 * | 6/2003 | Zolotarsky et al. | 205/503 |
| 2002/0148736 | A1 * | 10/2002 | Zolotarsky et al. | 205/505 |
| 2007/0134428 | A1 * | 6/2007 | Carlson et al. | 427/419.2 |

FOREIGN PATENT DOCUMENTS

EP 0135475 A1 3/1985

OTHER PUBLICATIONS

Veselovskaya, I.E., et al., *Electrochemical behavior of a ruthenium oxide anode at different ratios of ruthenium and titanium oxides* (1974), XP002658217, Chemical Abstracts Service, Columbus, OH.
Hine, F., et al., *Studies on the Oxide-Coated Metal Anodes for Chlor-Alkali Cells* (1977), J. Electrochem. Soc., Electrochemical Science and Technology, vol. 124, No. 4, pp. 500-505.
Evdokimov, S.V., *Electrochemical and Corrosion Behavior of Electrode Materials Based on Compositions of Ruthenium Dioxide and Base-Metal Oxides* (2002), Russian Journal of Electrochemistry, vol. 38, No. 6, pp. 583-588.
Roginskaya, Y.E., et al., *On the Character of Solid Solutions in Ruthenium-Titanium Oxide Anodes* (1989), Materials Chemistry and Physics, vol. 22, pp. 203-229.
Roginskaya, Y.E., et al., *The Role of Hydrated Oxides in Formation and Structure of DSA-Type Oxide Electrocatalysts* (1995), Electrochimica Acta, vol. 40, No. 7, pp. 817-822.
Santana, M.H.P., et al., *Investigation of surface properties of Ru-based oxide electrodes containing Ti, Ce and Nb* (2003), Electrochimica Acta, vol. 48, pp. 1885-1891.
Duvigneaud, P.H., et al., *Effect of Chlorine on Solid Solution Formation in Ruthenium Titanium Dioxide Coatings* (1984), Journal of Solid State Chemistry, vol. 52, pp. 22-31.
Aparicio, M., et al., *Thin and Thick $RuO_2$-$TiO_2$ Coatings on Titanium Substrates by the Sol-Gel Process* (2004). Journal of Sol-gel Science and Technology, vol. 29, pp. 81-88.
Panic, V.V., et al., $RuO_2$-$TiO_2$ coated titanium anodes obtained by the sol-gel procedure and their electrochemical behaviour in the chlorine evolution reaction (1999), Celloids and Surfaces, A: Physicochemical and Engineering Aspects, vol. 157, pp. 269-274.
Panic, V., et al., *On the deactivation mechanism of $RuO_2$-$TiO_2$/Ti anodes prepared by the sol-gel procedure* (2005), Journal of Electroanalytical Chemistry, vol. 579, pp. 67-76.
Osman, J.R., et al., *$RuO_2$-$TiO_2$ mixed oxides prepared from the hydrolysis of the metal alkoxides* (2008), Materials Chemistry and Physics, vol. 110, pp. 256-262, www.sciencedirect.com.
Colomer, M.T., et al., Rutile-type dense ceramics fabricated by pressureless sintering of $Ti_1$-$xRu_xO_2$ powders prepared by sol-gel (2007), Journal of the European Ceramic Society, vol. 27, pp. 2369-2376, www.sciencedirect.com.
Malek, J., et al., *Sol-Gel Preparation of Rutile Type Solic Solution in $TiO_2$-$RuO_2$ System* (2000), Journal of Thermal Analysts and Calorimetry, vol. 60, pp. 699-705.
Colomer, M.T., *Structural, Microstructural, and Electrical Transport Properties of $TiO_2$-$RuO_2$ Ceramic Materials Obtained by Polymeric Sol-Gel Route* (2000), Chem. Mater., vol. 12, pp. 923-930, American Chemical Society.
Colomer, M.T., et al., *Synthesis and thermal evolution of $TiO_2$- $RuO_2$ xerogels* (2006), J Sol-Gel Sci Techn, vol. 39, pp. 211-222.
Barnard, A.S., et al., *Prediction of $TiO_2$ Nanoparticle Phase and Shape Transitions Controlled by Surface Chemistry* (2005), Nano Letters, vol. 5, No. 7, pp. 1261-1266.

* cited by examiner

*Primary Examiner* — Bruce Bell
(74) *Attorney, Agent, or Firm* — Novak Druce Connolly Bove + Quigg LLP

(57) ABSTRACT

The present invention relates to an electrode that includes an electrically conducting substrate based on a valve metal having a main proportion of titanium, tantalum or niobium, and an electrocatalytically active coating comprising up to 50 mol % of a noble metal oxide or noble metal oxide mixture and at least 50 mol % of titanium oxide. The coating includes a minimum proportion of oxides of anatase structure determined by a ratio of the signal height of the most intensive anatase reflection in an x-ray diffractogram ($Cu_{K\alpha}$ radiation) after subtraction of a linear background to the signal height of the most intensive rutile reflection in the same diffractogram, wherein the ratio is at least 0.6.

20 Claims, 1 Drawing Sheet

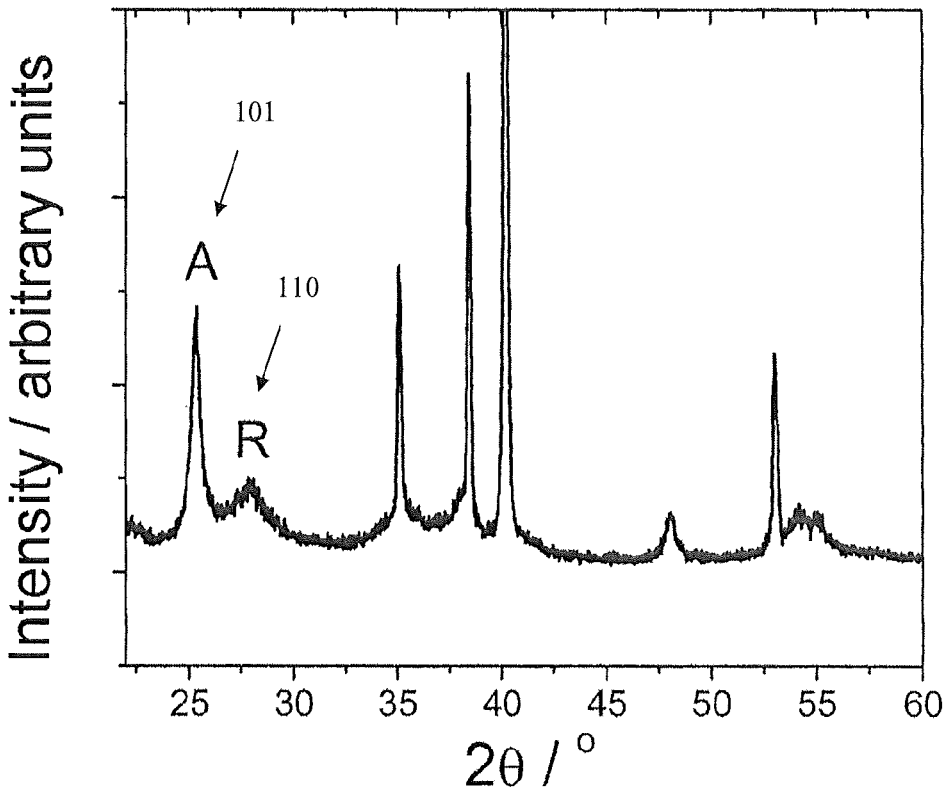
101
A
110
R
Intensity / arbitrary units
25
30
35
40
45
50
55
60
2θ / °

ELECTRODE FOR ELECTROLYTIC PRODUCTION OF CHLORINE

CROSS REFERENCE TO RELATED APPLICATIONS

Priority is claimed to German Patent Application No. 10 2010 030 293.7, filed Jun. 21, 2010, which is incorporated herein by reference in its entirety for all useful purposes.

BACKGROUND OF THE INVENTION

The invention proceeds from known electrodes consisting at least of an electrically conducting substrate based on a valve metal and an electrocatalytically active coating of a noble metal oxide or noble metal oxide mixture and titanium oxide.

Prior art chlorine production utilizes electrode coatings consisting of ruthenium-titanium oxide mixtures (e.g. dimensionally stable anodes, DSA™). The composition of the coating, i.e. the ratio of ruthenium to titanium oxide, is the decisive factor in that it decides electrocatalytic activity. Commercial DSA™ consist of 30 mol % $RuO_2$ and 70 mol % $TiO_2$. As described in J. Electrochem, Soc. 124, 500 (1977), the coating is composed of a main phase consisting of a $TiO_2$-ruthenium oxide solid solution of rutile structure, and of secondary phases of pure ruthenium oxide and a pure anatase phase. U.S. Pat. No. 3,562,008 describes a coating of predominantly amorphous titanium oxide with crystalline noble metal oxide or noble metal. Furthermore, as described in Russ. J. Electrochem, 38, 583 (2002) and Mat. Chem. and Phys. 22, 203 (1989), hydrated ruthenium oxide can be present alongside amorphous, hydrated oxide phases. The printed publications Electrochimica Acta 40, 817 (1995) and Electrochimica Acta 48, 1885 (2003) show that $RuO_2$—$TiO_2$ coatings produced by means of a thermal decomposition process result in a product which has a structural short range order. These heterogeneously constructed layers contain microclusters of $RuO_2$ and $TiO_2$ domains, which are randomly distributed in the layer. The electronic conductivity of these layers can be described in terms of percolation theory (Journal of Solid State Chemistry 52, 22 (1984)). The theory explains the conductivity of very finely divided and conductive particles ($RuO_2$ domains) in an insulating matrix of $TiO_2$ domains. According to this theory, the electronic properties are determined by the homogeneity of the mixed oxide. Any activity enhancement and any improvement in the useful life of the coating is only achievable when the active component $RuO_2$ can be homogeneously distributed on a molecular scale. Such a distribution of $RuO_2$ in a $TiO_2$ matrix can be achieved, as described in Journal of Sol-Gel Science and Technology 29, 81 (2004) and Colloids and Surface A 157, 269 (1999), by the use of a sol-gel process. In this sol-gel process, the components become distributed at a molecular level as a result of the hydrolysis of suitable precursor substances. The advantages of the sol-gel process are:

1. The reaction at low temperatures makes it possible to produce very small nanostructures.
2. The hydrolysis of the starting materials gives rise to products ($RuO_2$—$TiO_2$) which are divided homogeneously and at a molecular level, and are formed by chemical interactions (e.g. bonds). The homogeneous distribution of the resulting oxides in the electrode coating gives rise to electronic paths of conductance which ensure optimum flow of current.

In contrast to coatings produced via thermal decomposition of labile starting materials, layers produced by the sol-gel process exhibit better electronic and mechanical properties due to the homogeneity of the mixing operation. This additionally provides higher stability to the layers. As stated in Journal of Electroanalytical Chemistry 579, 67 (2005), samples produced via sol-gel processes show that the impedance of the samples rises less in the course of chlorine evolution than that of samples produced via thermal decomposition. This observation suggests higher activity for the samples produced via sol-gel processes. One disadvantage of the sol-gel route is the limited scope for varying the phase composition in the binary $RuO_2TiO_2$ layer. Phase composition can be controlled to a small extent by varying the pH, the starting composition and the sintering temperature. These possibilities are described in Materials Chemistry and Physics 110, 256 (2008), Journal of the European Ceramic Society 27, 2369 (2007), Journal of Thermal Analysis and calorimetry 60, 699 (2000), Chem. Mater. 12, 923 (2000) and J. Sol-Gel. Sci, Techn 39, 211 (2006). The phase formation behaviour between $RuO_2$—$TiO_2$ is described in Journal of the Electrochemical Society 124, 500 (1977). $TiO_2$ occurs in two polymorphic phases, rutile and anatase. While anatase is stable at low temperatures, rutile occurs at high temperatures only. The phases can be converted into each other via thermal treatment. A further possibility of conversion is the addition of a second component in the form of a dopant. This dopant adds onto the $TiO_2$ structure and thereby influences the coordination which leads to the formation of a homogeneous rutile or anatase phase. By the very good lattice matching between tetragonal $RuO_2$ and tetragonal $TiO_2$ (rutile), the formation of the latter is favoured. Therefore, conventional coatings have a main constituent consisting of a solid mixture of $RuO_2/TiO_2$ with corresponding tetragonal structure. Depending on the method of production, layers having an $RuO_2$ content of 20-40 mol % may contain small proportions of anatase phase. The thermodynamic stability of the structure, i.e. the bonding behaviour of the $MO_6$ octahedra of Ru and Ti, depends on the free surface energy of the nanoparticles, which is influenced by the surface chemistry (oxide and hydroxide formation, water adsorption) (Nano Letter 5, 1261 (2005)). In general, the thermally induced crystallization of amorphous phases under oxidizing conditions leads to a coating structure having a rutile phase as main proportion. This process is due to oxygen surface adsorption. Hitherto no electrocatalytically active coating systems having a main proportion of anatase phase are known.

Surprisingly, it was found, coatings having an increased anatase fraction exhibit an increased electrocatalytic activity for chlorine evolution in comparison with layers based on rutile structure. This invention accordingly has for its object to produce electrocatalytically active coatings having a main proportion of anatase phase.

BRIEF DESCRIPTION OF THE INVENTION

An embodiment of the present invention is an electrode comprising an electrically conducting substrate based on a valve metal having a main proportion of titanium, tantalum or niobium, and an electrocatalytically active coating comprising up to 50 mol % of a noble metal oxide or noble metal oxide mixture and at least 50 mol % of titanium oxide, wherein the coating comprises a minimum proportion of oxides of anatase structure determined by a ratio of the signal height of the most intensive anatase reflection in an x-ray diffractogram ($Cu_{K\alpha}$ radiation) after subtraction of a linear background to the signal height of the most intensive rutile reflection after subtraction of a linear background in the same diffractogram, wherein the ratio is at least 0.6.

Another embodiment of the present invention is the above electrode, wherein the noble metal oxide is an oxide of a metal selected from the group consisting of ruthenium, iridium, platinum, gold, rhodium, palladium, silver, rhenium, and mixtures thereof.

Another embodiment of the present invention is the above electrode, wherein the noble metal oxide is an oxide of ruthenium or iridium.

Another embodiment of the present invention is the above electrode, wherein the electrocatalytically active layer comprises from 10 to 50 mol % of the noble metal oxide or noble metal oxide mixture.

Another embodiment of the present invention is the above electrode, wherein the electrocatalytically active layer comprises from 15 to 50 mol % of the noble metal oxide or noble metal oxide mixture.

Another embodiment of the present invention is the above electrode, wherein the proportion of the titanium oxide is in the range from 50 to 90 mol %.

Another embodiment of the present invention is the above electrode, wherein the proportion of the titanium oxide is in the range from 50 to 85 mol %.

Yet another embodiment of the present invention is a process comprising dissolving a noble metal salt in an organic solvent; adding a soluble titanium compound in an organic and/or aqueous solution; mixing the solution; hydrolyzing the noble metal salts using water, an aqueous acid, or mixtures thereof; applying the solution to an electrically conducting substrate in one or more stages; removing the solvent; thermally aftertreating at a temperature of not more than 250° C., and at a pressure from 10 to 100 bar in the presence of water vapour and optionally of a lower alcohol; and calcining in the presence of an oxygen-containing gas at a temperature of more than 300° C.; to form an electrode having an electrocatalytically active coating on an electrically conducting substrate.

Another embodiment of the present invention is the above process, wherein the soluble titanium compound is $Ti(iOPr)_4$.

Another embodiment of the present invention is the above process, wherein the aqueous acid is selected from the group consisting of acetic acid, propionic acid, HCL, $HNO_3$, and mixtures thereof.

Another embodiment of the present invention is the above process, wherein the thermal aftertreating is performed at a temperature from 100 to 250° C.

Another embodiment of the present invention is the above process, wherein the calcining is performed at a temperature from 400 to 600° C.

Another embodiment of the present invention is the above process, wherein the calcining is performed at a temperature from 450 to 550° C.

Another embodiment of the present invention is the above process, wherein the noble metal salt is selected from the group consisting of a chloride, a nitrate, an alkoxide, an acetylacetonate of the noble metal, and mixtures thereof.

Another embodiment of the present invention is the above process, wherein the noble metal salt is a noble metal chloride.

Another embodiment of the present invention is the above process, wherein the organic solvent comprises at least one $C_1$ to $C_8$ alcohol.

Another embodiment of the present invention is the above process, wherein the organic solvent is selected from the group consisting of methanol, n-propanol, i-propanol, n-butanol, t-butanol, and mixtures thereof.

Yet another embodiment of the present invention is an electrode obtained from the above process.

Yet another embodiment of the present invention is an electrolyser comprising the above electrode.

Yet another embodiment of the present invention is the above electrode wherein the ratio of the signal height of the most intensive anatase reflection in an x-ray diffractogram ($Cu_{K\alpha}$ radiation) after subtraction of a linear background to the signal height of the most intensive rutile reflection after subtraction of a linear background in the same diffractogram is at least 1.

BRIEF DESCRIPTION OF THE DRAWING

FIG. 1 shows an x-ray diffractogram of the solvothermally pretreated sample from Example 1.

DETAILED DESCRIPTION OF THE INVENTION

The invention relates to the production of an electrode coating for electrolytic production of chlorine, which comprises a noble metal oxide component and a titanium oxide with anatase-rutile mixture having a particular minimum anatase fraction.

One particular electrode is characterized in that the coating includes a proportion of anatase structure, characterized in that, in each case after subtraction of a linear background, the peak height of the most intensive anatase reflection (reflection (101)) in the x-ray diffractogram ($Cu_{K\alpha}$ radiation) has at least 60% of the height of the most intensive rutile reflection (reflection (110)) in the x-ray diffractogram. The specific adjustment of the composition and the influencing of the microstructure of the electrode coating is achieved via a two-stage process for example. In this two-stage process, a thermally stabilized and amorphous starting phase, which is produced in a sol-gel operation, is first crystallized in a solvothermal treatment and then using a thermal aftertreatment.

A material with anatase structure is herein any material having a structure of the anatase structure type.

A solvothermal treatment for the purposes of the invention is a treatment at elevated pressure, compared with the ambient pressure, and elevated temperature, compared with room temperature.

In contrast to the prior art, the process described herein provides a coating having a higher anatase fraction which leads to direct efficiency enhancement in chlorine production.

For this, to crystallize an amorphous starting mixture, a solvothermal process having a process temperature of not more than 250° C., preferably in the range from 100 to 250° C. and a process pressure of 1 to 10 MPa has proved suitable.

The invention provides an electrode consisting at least of an electrically conducting substrate based on a valve metal, more particularly a metal selected from titanium, tantalum, niobium or an alloy thereof, having a main proportion of titanium, tantalum or niobium and an electrocatalytically active coating with up to 40 mol % of a noble metal oxide or noble metal oxide mixture and at least 60 mol % of titanium oxide, characterized in that the coating includes a minimum proportion of oxides of anatase structure, said minimum proportion being determined by the ratio of the signal height of the most intensive anatase reflection (101) in an x-ray diffractogram ($Cu_{K\alpha}$ radiation) to the signal height of the most intensive rutile reflection (110) each after subtraction of a linear background in the same diffractogram, wherein the ratio has a value of at least 0.6 and preferably at least 1.

Preference is given to an electrode that is characterized in that the noble metal oxide is an oxide of one or more metals selected from the group consisting of ruthenium, iridium, platinum, gold, rhodium, palladium, silver, rhenium. Oxides of ruthenium or of iridium are particularly preferred for use as noble metal oxide.

Preferably the electrocatalytically active layer includes 10 to 50 mol % of the noble metal oxide or noble metal oxide mixture, more preferably 15 to 50 mol %.

In a preferred embodiment of the electrode, the proportion of the titanium oxide component is in the range from 50 to 90 mol % and preferably in the range from 50 to 85 mol %.

The invention further provides a process for producing an electrode having an electrocatalytically active coating on an electrically conducting substrate, more particularly an above-described novel electrode, having the steps of:

Dissolving noble metal salts, more particularly noble metal chlorides, in an aqueous solvent, adding a soluble titanium compound, more particularly $Ti(iOPr)_4$ in organic and/or aqueous solution, mixing the solution, hydrolyzing the salts using water and/or aqueous acids, more particularly acetic acid, propionic acid, HCl or $HNO_3$, applying the solution to an electrically conducting substrate in one or more stages, removing the solvent, thermally aftertreating the resulting layer at the temperature of not more than 250° C., preferably 100 to 250° C. and at a pressure of 10 to 100 bar (1 to 10 MPa) in the presence of water vapour and optionally of lower alcohols and subsequent calcining of the resulting layer in the presence of oxygen-containing gases at a temperature of more than 300° C., preferably 400 to 600° C. and more preferably 450° C. to 550° C.

The process according to the invention provides for example electrocatalytically active layers consisting of a 15-40 mol % noble metal component (e.g. $RuO_2$ or $RuO_2$/$IrO_2$ mixtures) and a $TiO_2$ phase having a main-proportioned anatase structure.

A main proportion of anatase structure is present when, in each case after subtraction of a linear background, the height of the most intensive reflection of the anatase structure (reflection (101)) in the x-ray diffractogram, divided by the height of the most intensive reflection of the rutile structure (reflection (110)), has a value of equal to or greater than 0.6.

The coating solutions are obtained for example via a sol-gel process, wherein the precursor salts used are preferably chlorides, nitrates, alkoxides or acetylacetonates of the aforementioned noble metals, which are dissolved in a solvent selected from $C_1$ to $C_8$ alcohols, more particularly methanol, n-propanol, i-propanol, n-butanol or t-butanol under agitation and ultrasound treatment. To avoid spontaneous hydrolyses and condensations between the starting materials, complexing agents such as acetylacetone or 4-hydroxy-4-methyl-2-pentanone are added. Water and/or acids such as acetic acid, propionic acid, HCl or $HNO_3$ are added for hydrolysis and condensation of the precursors. The coating solution prepared in this way is used for coating electronically conductive materials such as for example titanium, tantalum and niobium or alloys thereof. These materials can be present in different geometries e.g.: sheets; wires or nets. A mechanical, chemical or electrochemical treatment of the substrates is possibly required in order that any oxide layers present may be removed and in order that mechanical bonding strength of the coating may be achieved through enlargement of the substrate surface area. The coating solution can be applied using processes such as dripping, spin-coating, spraying, dipping or brushing. The layer resulting therefrom is air dried and then thermally stabilized at 100-250° C. Thicker layers are obtainable via multiple repetition of the steps described heretofore. After thermal stabilization, the coatings exhibit an amorphous structure, which is crystallized by the process according to the invention.

The solvothermal process is carried out for example in a steel cylinder which can be tightly sealed and heated. The necessary processing pressure is achieved via a vaporizable liquid in a Teflon insert in the interior of the steel cylinder. The sample itself hangs or lies inside a glass vessel in the Teflon insert. The processing pressure can be set via the amount of liquid and via the applied temperature. Water, solvents or dilute sol solutions can be used as liquids. The sealed steel cylinder is heated, for example at a rate of 10°/min, to 150-200° C. for a period of 3-24 hours. This gives rise to a pressure of 1-10 MPa in the interior of the steel cylinder. After the coated sample has been cooled down to room temperature, a thermal aftertreatment is carried out for 1-2 hours at more than 300° C. preferably 400 to 600° C., preferably at 450° C. to 550° C.

Electrochemical tests (cyclic voltammetry for example) can then be carried out to characterize the chlorine evolution by means of the electrode formed.

It was found in the course of such tests that the thermal aftertreatment provides a distinct improvement in the performance of such electrodes over known electrodes. As the exemplary embodiments show, the samples with solvothermal pretreatment have distinctly higher electrocatalytic activity compared with samples treated purely thermally.

The invention further provides for the use of the electrode according to the invention as anode in electrolysers for the electrolysis of (aqueous) sodium chloride or hydrogen chloride solutions in the electrochemical production of chlorine.

The invention further provides an electrolyser for electrolysis of solutions comprising sodium chloride or hydrogen chloride, characterized in that an electrode according to the invention is provided as anode.

The present invention is illustrated with reference to the following exemplary embodiments, which in no way restrict the invention however.

FIG. 1 shows an x-ray diffractogram of the solvothermally pretreated sample from Example 1

The meanings are:

A: reflection (101) of the phase of the anatase structure type

R: reflections (110) of the phase of the rutile structure type

All the references described above are incorporated by reference in their entireties for all useful purposes.

While there is shown and described certain specific structures embodying the invention, it will be manifest to those skilled in the art that various modifications and rearrangements of the parts may be made without departing from the spirit and scope of the underlying inventive concept and that the same is not limited to the particular forms herein shown and described.

EXAMPLES

Example 1

Titanium discs having a diameter of 15 mm (thickness: 2 mm) are sandblasted and then etched in 10% oxalic acid at 80° C. for 2 hours. Thereafter, the platelets are removed from the acid and washed with 2-propanol. They are dried in a stream of nitrogen. To prepare the first component (solution A) of the sol solution, 168.5 mg of $RuCl_3.xH_2O$ (36% Ru) are dissolved in 6 ml of 2-propanol and stirred for 12 hours. Solution B is prepared from 333.1 μl of $Ti(i\text{-}OPr)_4$ and 561.5 μl of 4-hydroxy-4-methyl-2pentanone previously dissolved in 7.52 ml of 2-propanol. Homogenization is by stirring for 30 minutes. Solutions A and B are combined under ultrasonication. The result is a transparent solution. Thereafter, 12.9 μl of acetic acid and 27 μl of deionized water are added for hydrolysis. The resulting mixture is stirred at room temperature for 12 hours. Before this mixture can be used as a coating solution, it is diluted with 26.67 ml of 2-propanol. 50 μl of this solution are dripped onto the titanium platelets described above, followed by air drying. This operation is repeated 24 times with thermal stabilization at 200° C. for 10 minutes after every fourth application. The result is an amorphous coating having a chemical composition of 40 mol % $RuO_2$ and 60 mol % $TiO_2$. This corresponds to a ruthenium loading of 10.3 g/m$^2$. The solvothermal treatment is effected in the above-described steel autoclave having a 250 ml Teflon insert filled with 30 ml of coating solution (37.5 mMol). The coated sample is laid into a glass vessel, which is placed into the Teflon insert. The sealed autoclave is heated at 10° C./min to 150° C. and left at 150° C. for 24 hours. After cooling to room temperature, the coated substrate is thermally aftertreated in air at 450° C. for 1 hour. The control sample without solvothermal pretreatment is merely given the thermal treatment in air at 450° C. for 1 hour. Phase analysis is done via x-ray diffractometry. FIG. 1 shows the x-ray diffractogram of a sample with solvothermal pretreatment. It is apparent that the coating predominantly contains an anatase structure content. After subtraction of a linear background, the ratio of the height of the most intensive reflection of the anatase structure (reflection (101)) in the x-ray diffractogram to the height of the most intensive reflection of the rutile structure (reflection (110)) is 3.96. Without solvothermal pretreatment, only the rutile phase occurs. The electrocatalytic activity for chlorine evolution was investigated via chronoamperometry (reference electrode: Ag/AgCl, 3.5 mol/l NaCl, pH: 3, T: 25° C.). A current density of 1 kA/m$^2$ was applied and the potential was determined. The potential found is 1.18 V for the solvothermally pretreated sample and 1.32 V for the purely thermally treated sample.

Example 2

The titanium substrates are treated as described in Example 1. To prepare the first component (solution A) of the sol solution, 105.3 mg of $RuCl_3H_2O$ (36% Ru) are dissolved in 488 ml of 2-propanol and stirred for 12 hours. Solution B is prepared from 333.1 of $Ti(i\text{-}OPr)_4$ and 561.5 μl of 4-hydroxy-4-methyl-2-pentanone previously dissolved in 7.52 ml of 2-propanol. Homogenization is by stirring for 30 minutes. Solutions A and B are combined under ultrasonication. The result is a transparent solution. Thereafter, 12.9 μl of acetic acid and 27 μl of deionized water are added for hydrolysis. The resulting mixture is stirred at room temperature for 12 hours. Before this mixture can be used as a coating solution, it is diluted with 26.67 ml of 2-propanol. 50 μl of this solution are dripped onto the titanium platelets described above, followed by air drying. This operation is repeated 24 times with thermal stabilization at 100° C. for 10 minutes after every fourth application. The result is an amorphous coating having a chemical composition of 25 mol % $RuO_2$ and 75 mol % $TiO_2$. This corresponds to a ruthenium loading of 6.4 g/m$^2$. The solvothermal pretreatment and the thermal aftertreatment are carried out as described in Example 1. The control sample without solvothermal pretreatment is merely given the thermal treatment in air at 450° C. for 1 hour. Phase analysis is done via x-ray diffractometry.

It is apparent from the x-ray diffractogram of a sample without solvothermal pretreatment that there is a rutile-anatase structure mixture having a predominant rutile content. After deduction of a linear background the ratio of the height of the most intensive reflection of the anatase structure (reflection (101)) in the x-ray diffractogram to the height of the most intensive reflection of the rutile structure (reflection (110)) is 0.18. The x-ray diffractogram of a sample with solvothermal pretreatment shows that the coating predominantly contains an anatase structure content. After subtraction of a linear background, the ratio of the height of the most intensive reflection of the anatase structure (reflection (101)) in the x-ray diffractogram to the height of the most intensive reflection of the rutile structure (reflection (110)) is 1.81. The electrocatalytic activity for chlorine evolution was investigated via chronoamperometry (reference electrode: Ag/AgCl, 3.5 mol/l NaCl, pH: 3, T: 25° C.). A current density of 1 kA/m$^2$ was applied and the potential was determined. The potential found is 1.23 V for the solvothermally pretreated sample and 1.42 V for the purely thermally treated sample.

Example 3

The titanium substrates are treated as described in Example 1. To prepare the first component (solution A) of the sol solution, 105.3 mg of $RuCl_3.xH_2O$ (36% Ru) are dissolved in 4.88 ml of 2-propanol and for 12 hours. Solution B is prepared from 333.1 of $Ti(i\text{-}OPr)_4$ and 561.5 μl of 4-hydroxy-4-methyl-2-pentanone previously dissolved in 7.52 ml of 2-propanol. Homogenization is by stirring for 30 minutes. Solutions A and B are combined under ultrasonication. The result is a transparent solution. 12.9 μl of acetic acid and 27 μl of deionized water are added for hydrolysis. The resulting mixture is stirred at room temperature for 12 hours. Before this mixture can be used as a coating solution, it is diluted with 26.67 ml of 2-propanol. 50 μl of this solution are dripped onto the titanium platelets described above, followed by air drying. This operation is repeated 24 times with thermal stabilization at 250° C. for 10 minutes after every fourth application. The result is an amorphous coating having a chemical composition of 25 mol % $RuO_2$ and 75 mol % $TiO_2$. This corresponds to a ruthenium loading of 6.4 g/m$^2$. The solvothermal treatment is effected as described in Example 1 in a steel autoclave having a 250 ml Teflon insert filled with 30 ml of coating solution (37.5 mMol). The coated sample is laid into a glass vessel, which is placed into the Teflon insert. The sealed autoclave is heated at 10° C./min to 150° C. and left at 150° C. for 24 hours. After cooling to room temperature, the coated substrate is thermally aftertreated in air at 450° C. for 1 hour. The control sample without solvothermal pretreatment is merely given the thermal treatment in air at 450° C. for 1 hour. Phase analysis is done via x-ray diffractometry. The x-ray diffractogram of a sample without solvothermal pretreatment shows that only a rutile phase is present. The x-ray diffractogram of the sample with solvothermal pretreatment shows that the coating contains an anatase structure content in addition to the rutile content. After subtraction of a linear background, the ratio of the height of the most intensive reflection of the anatase structure (reflection (101)) in the x-ray diffractogram to the height of the most intensive reflection of the rutile structure (reflection (110)) is 0.21.

The electrocatalytic activity for chlorine evolution was investigated via chronoamperometry (reference electrode: Ag/AgCl, 3.5 mol/l NaCl, pH: 3, T: 25° C.). A current density of 1 kA/m$^2$ was applied and the potential was determined. The potential found is 1.32 V for the solvothermally pretreated sample and 1.41 V for the purely thermally treated sample.

Example 4

The titanium substrates are treated as described in Example 1. To prepare the first component (solution A) of the sol solution, 63.2 mg of $RuCl_3.xH_2O$ (36% Ru) are dissolved in 1.26 ml of 2-propanol and stirred for 12 hours. Solution B is prepared from 377.5 of $Ti(i\text{-}OPr)_4$ and 561.5 μl of 4-hydroxy-4-methyl-2-pentanone previously dissolved in 11.1 ml of 2-propanol. Homogenization is by stirring for 30 minutes. Solutions A and B are combined under ultrasonication. The result is a transparent solution. Thereafter, 12.9 μl of acetic acid and 27 μl of deionized water are added for hydrolysis. The resulting mixture is stirred at room temperature for 12 hours. Before this mixture can be used as a coating solution, it is diluted with 26.67 ml of 2-propanol. 50 μl of this solution are dripped onto the titanium platelets described above, followed by air drying. This operation is repeated 8 times with thermal stabilization at 200° C. for 10 minutes after every application. The result is an amorphous coating having a chemical composition of 15 mol % $RuO_2$ and 85 mol % $TiO_2$. This corresponds to a ruthenium loading of 3.86 g/m$^2$, The solvothermal treatment is effected as described in Example 1 in a steel autoclave having a 250 ml Teflon insert filled with 30 ml of coating solution (37.5 mMol). The coated sample is laid into a glass vessel, which is placed into the Teflon insert. The sealed autoclave is heated at 10° C./min to 150° C. and left at 150° C. for 3 hours. After cooling to room temperature, the coated substrate is thermally aftertreated in air at 250, 300, 350, 400 and 450° C. for 10 minutes in each case. The x-ray diffractogram of the sample reveals that a rutile-anatase mixture having a high proportion of rutile phase is present. After subtraction of a linear background, the ratio of the height of the most intensive reflection of the anatase structure (reflection (101)) in the x-ray diffractogram to the height of the most intensive reflection of the rutile structure (reflection (110)) is 0.10. The electrocatalytic activity for chlorine development was investigated by chronoamperometry (reference electrode: Ag/AgCl, 3.5 mol/l NaCl, pH: 3, T: 25° C.). A current density of 1 kA/m$^2$ was applied and the potential determined. A potential of 1.27 V was found.

The invention claimed is:

1. An electrode comprising an electrically conducting substrate based on a valve metal having a main proportion of titanium, tantalum or niobium, and an electrocatalytically active coating comprising up to 50 mol % of a noble metal oxide or noble metal oxide mixture and at least 50 mol % of titanium oxide, wherein the coating comprises a minimum proportion of oxides of anatase structure determined by a ratio of the signal height of the most intensive anatase reflection in an x-ray diffractogram ($Cu_{K\alpha}$ radiation) to the signal height of the most intensive rutile reflection each after subtraction of a linear background in the same diffractogram, wherein the ratio is at least 0.6.

2. The electrode according to claim 1, wherein the noble metal oxide is an oxide of a metal selected from the group consisting of ruthenium, iridium, platinum, gold, rhodium, palladium, silver, rhenium, and mixtures thereof.

3. The electrode according to claim 2, wherein the noble metal oxide is an oxide of ruthenium or iridium.

4. The electrode according to claim 1, wherein the electrocatalytically active layer comprises from 10 to 50 mol % of the noble metal oxide or noble metal oxide mixture.

5. The electrode according to claim 4, wherein the electrocatalytically active layer comprises from 15 to 50 mol % of the noble metal oxide or noble metal oxide mixture.

6. The electrode according to any claim 1, wherein the proportion of the titanium oxide is in the range from 50 to 90 mol %.

7. The electrode according to claim 6, wherein the proportion of the titanium oxide is in the range from 50 to 85 mol %.

8. An electrolyser comprising the electrode according to claim 1 as an anode.

9. The electrode according to claim 1, wherein the ratio is at least 1.

10. A process comprising dissolving a noble metal salt in an organic solvent;

adding a soluble titanium compound in an organic and/or aqueous solution;

mixing the solution;

hydrolyzing the noble metal salts using water, an aqueous acid, or mixtures thereof;

applying the solution to an electrically conducting substrate in one or more stages;

removing the solvent;

thermally aftertreating at a temperature of not more than 250° C., and at a pressure from 10 to 100 bar in the presence of water vapour and optionally of a lower alcohol; and calcining in the presence of an oxygen-containing gas at a temperature of more than 300° C.;

to form an electrode having an electrocatalytically active coating on an electrically conducting substrate.

11. The process according to claim 10, wherein the soluble titanium compound is $Ti(iOPr)_4$.

12. The process according to claim 10, wherein the aqueous acid is selected from the group consisting of acetic acid, propionic acid, HCL, $HNO_3$, and mixtures thereof.

13. The process according to claim 10, wherein the thermal aftertreating is performed at a temperature from 100 to 250° C.

14. The process according to claim 10, wherein the calcining is performed at a temperature from 400 to 600° C.

15. The process according to claim 14, wherein the calcining is performed at a temperature from 450 to 550° C.

16. The process according to claim 10, wherein the noble metal salt is selected from the group consisting of a chloride, a nitrate, an alkoxide, an acetylacetonate of the noble metal, and mixtures thereof.

17. The process according to claim 16, wherein the noble metal salt is a noble metal chloride.

18. The process according to claim 10, wherein the organic solvent comprises at least one $C_1$ to $C_8$ alcohol.

19. The process according to claim 18, wherein, the organic solvent is selected from the group consisting of methanol, n-propanol, i-propanol, n-butanol, t-butanol, and mixtures thereof.

20. An electrode obtained from the process according to claim 10.

* * * * *